US005927543A

United States Patent [19]

Dejardin et al.

[11] Patent Number: 5,927,543

[45] Date of Patent: Jul. 27, 1999

[54] DISPENSER FOR GLOVES MADE OF SHEET MATERIAL

[76] Inventors: Pascal Dejardin, 133 Rue Berthelot 59860 Bruay, Escaut; Véronique Dejardin, 22 Rue Saint-Géry, 59300 Valenciennes; Nathalie Dejardin, 24 Allie du Parc, 59590 Raismes, all of France

[21] Appl. No.: 09/000,971

[22] Filed: Dec. 30, 1997

[30] Foreign Application Priority Data

Dec. 30, 1996 [FR] France ..... 96/16353

[51] Int. Cl.[6] ..... B65H 1/00

[52] U.S. Cl. ..... 221/56; 221/63

[58] Field of Search ..... 221/56, 59, 62, 221/303, 33, 309; 312/42, 50, 61, 71; 206/438, 278

[56] References Cited

U.S. PATENT DOCUMENTS 3,486,657 12/1969 Blatz ..... 221/33

4,844,293 7/1989 McLaughlin ..... 221/34

*Primary Examiner*—H. Grant Skaggs
*Assistant Examiner*—Gene O Crawford
*Attorney, Agent, or Firm*—Kerkam, Stowell, Kondracki & Clarke, P.C.; Edward J. Kondracki

[57] ABSTRACT

The invention relates to a glove dispenser comprising a box (5) essentially constituted by at least one wall which defines an internal volume capable of containing a batch of a predetermined number of gloves, in which wall is provided at least one slot (6) through which gloves can be extracted.

This dispenser is characterized in that the slot (6) of the box (5) has a cross section at least equal to the cross section that the batch (3) intended to be placed inside the box (5) has in a predetermined transverse plane of a group of fingers constituted by the stacking of the same fingers of the gloves (1) of a batch in such a way that this group of fingers can be inserted into the slot (6) at least as far as the transverse plane in question.

9 Claims, 3 Drawing Sheets

DISPENSER FOR GLOVES MADE OF SHEET MATERIAL

FIELD OF THE INVENTION

1. Background of the Invention

The invention relates to a dispenser for gloves made of sheet material.

The invention applies to the self-service, unit-by-unit dispensing of ambidextrous, single-use gloves, particularly but not exclusively at sites where motor vehicle fuels are sold.

2. Description of Related Art

The term glove hereinafter designates a flexible object into which a hand can be inserted and which comprises at least one finger.

The invention relates to the dispensing of single-use gloves which, being made of impermeable sheet material, have the advantage of being able to be stacked for packaging.

SUMMARY OF THE INVENTION

For self-service dispensing of gloves of this type, it is known for gloves to be assembled into at least one batch, and for this batch to be placed in a box called a dispenser equipped with a slot from which a person can remove gloves.

The known boxes have the drawback of allowing the removal of too many gloves, that is, the malicious removal of a large quantity of gloves in a single operation.

One object of the invention is precisely to obtain a dispenser which limits the number of gloves that can be removed in a single operation.

To this end, the subject of the invention is a dispenser of the above-mentioned type constituted of sheet material, this dispenser comprising a box essentially constituted by at least one wall, which defines an internal volume capable of containing a batch of a predetermined number of gloves (1) and houses at least one so-called securing device whose function is to hold the gloves of the batch in a stack from which each glove can only be separated when it receives a force of predetermined intensity, and in which wall is provided at least one slot through which gloves can be extracted, this dispenser being characterized in that:

at least one slot of the box has a cross-section at least equal to the cross-section that the batch intended to be placed inside the box has in a predetermined transverse plane of a group of fingers constituted by the stacking of the same fingers of the gloves in a batch, so that this group of fingers can be inserted into the slot at least as far as the transverse plane in question, the securing device is positioned inside the box in such a way that the predetermined group of fingers of the batch projects through the slot to the outside of the box by a predetermined length, so that each glove can only be separated from the batch when the one of its fingers that is inserted into the slot receives the force in a direction substantially parallel to its longitudinal axis.

BRIEF DESCRIPTION OF THE DRAWINGS

The invention will be more clearly understood with the aid of the following description given as a non-limiting example in reference to the appended drawing, which schematically represents.

DESCRIPTION OF THE PREFERRED EMBODIMENTS

Figure 1:
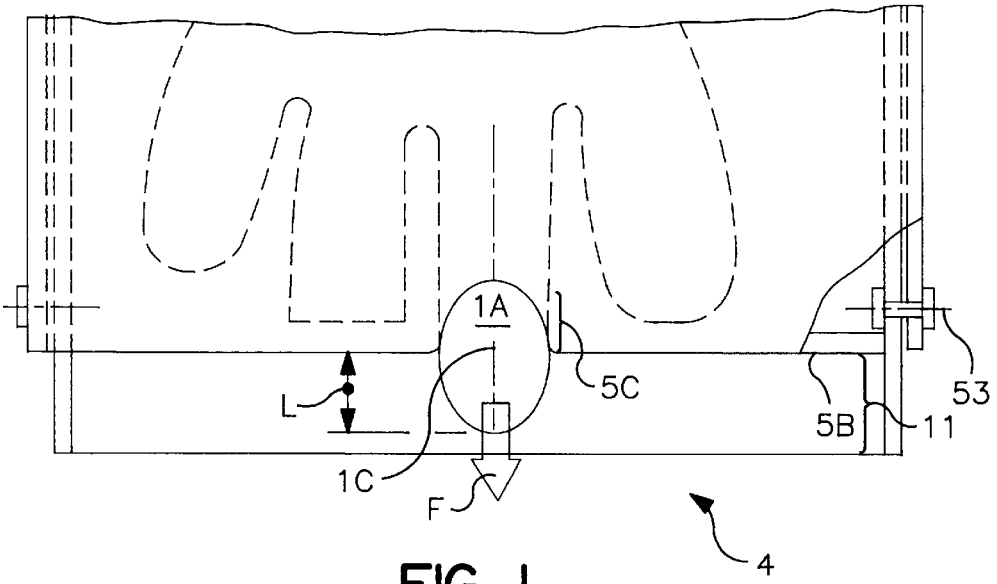
FIG. 1 is, a partial front view of a dispenser according to the invention.
Figure 2:
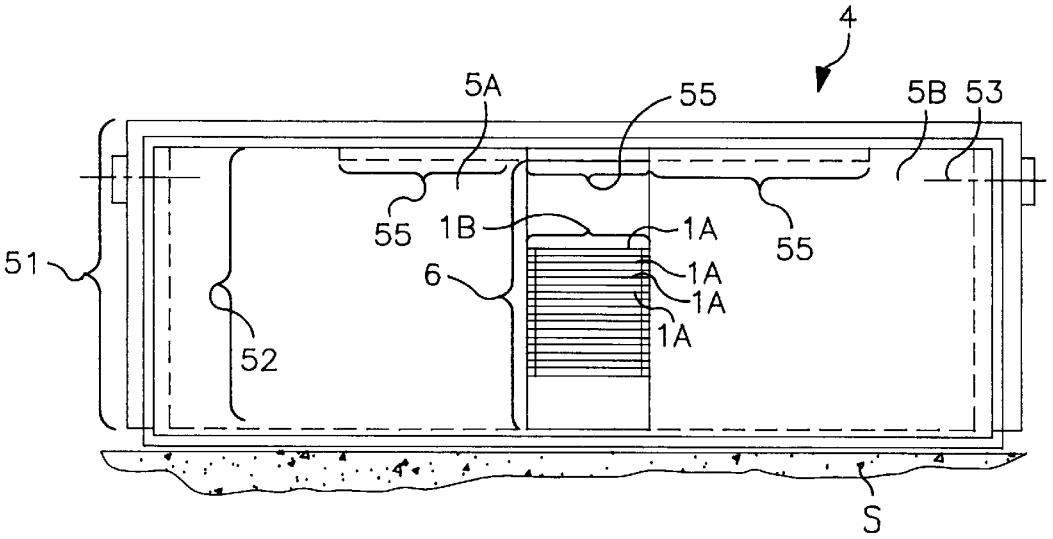
FIG. 2 is, a fragmentary, view of the dispenser in FIG. 1.
Figure 3:
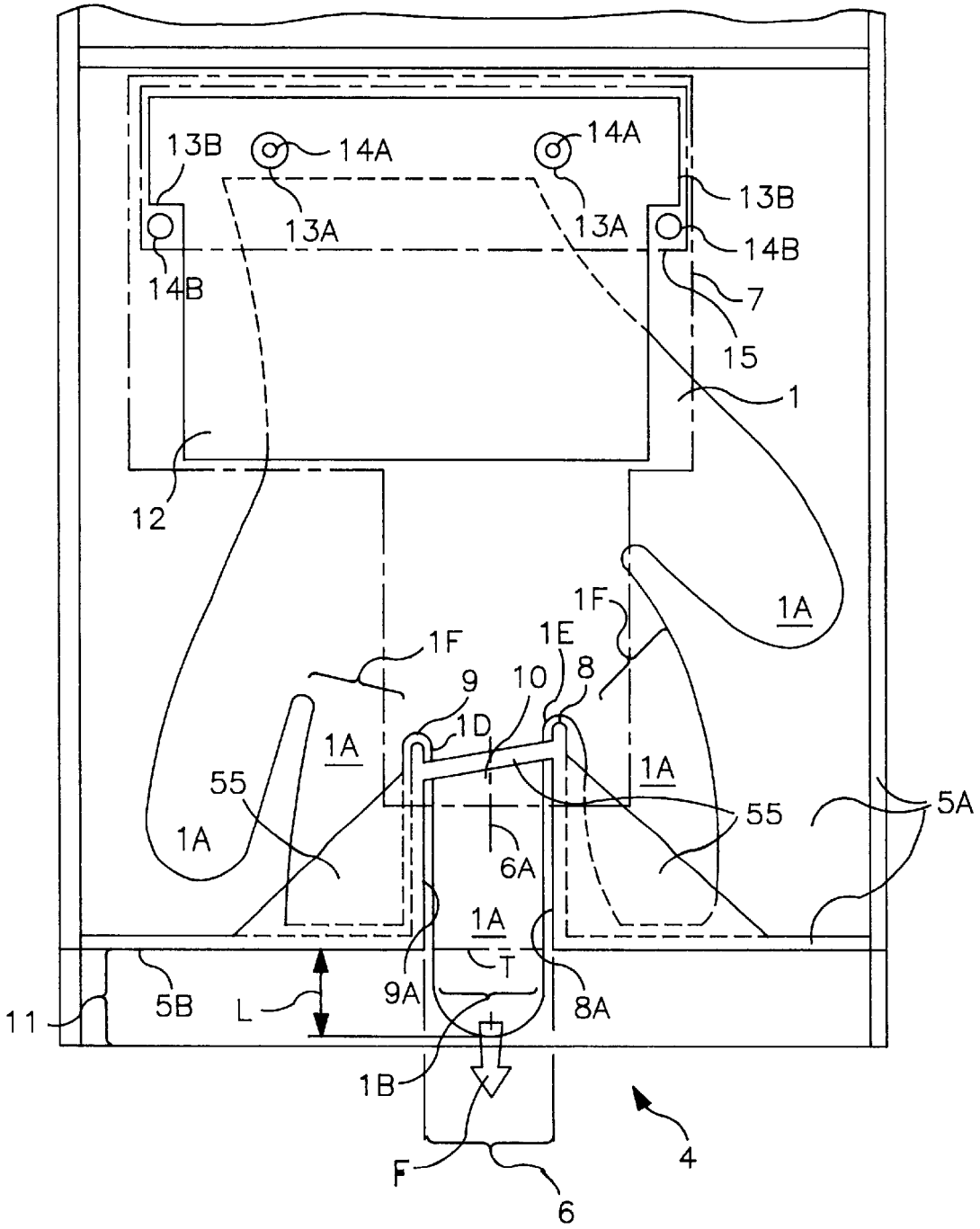
FIG. 3: a front view of the dispenser with its cover removed.
Figure 4:
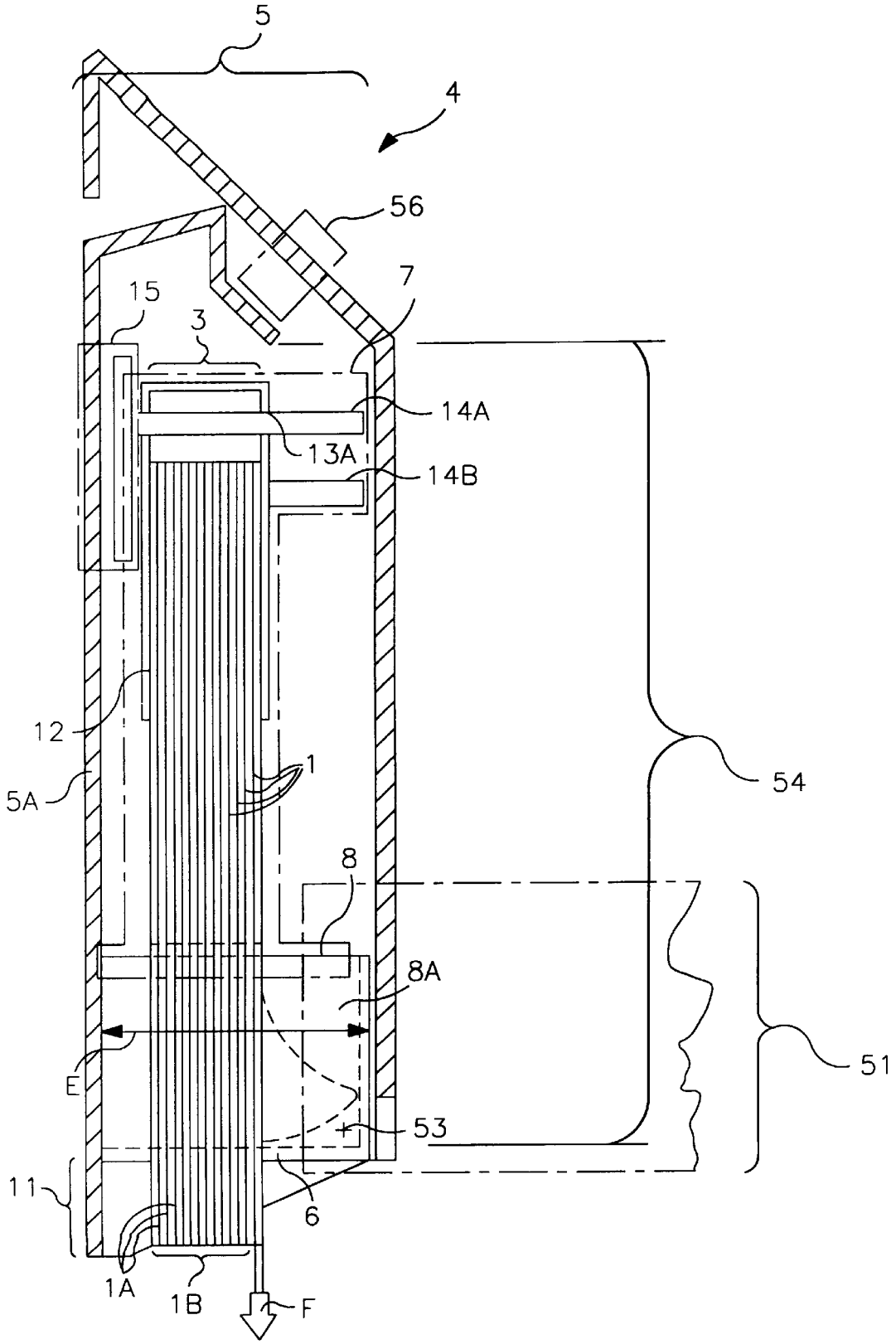
FIG. 4: a cross-sectional view of the dispenser in FIG. 1, with the open position of its cover symbolized by a fine dot-and-dash line.

Please refer to the drawing, which shows gloves 1 made of sheet material.

For example, the gloves 1 are ambidextrous, and are intended for single use.

The term glove 1 hereinafter designates a flexible object into which a hand (not shown) can be inserted and which comprises at least one finger 1A.

As shown in the drawing, the gloves 1 are stacked so as to constitute at least one substantially flat batch 3, placed in a dispenser 4.

The dispenser 4 comprises a box 5 essentially constituted by at least one wall 5A which defines an internal volume capable of containing a batch 3 of a predetermined number of gloves 1, in which wall 5A is provided at least one slot 6 through which gloves 1 can be extracted by a person (not shown).

In the non-limiting exemplary embodiment shown, the box 5 is in the form of an approximately parallelepipedic rectangular case and comprises walls which extend in different planes.

Although it is not shown, it is understood that the box is intended to be firmly attached (by means not represented) to a stable support S such as a wall, a post or the like, in order to have an appropriate height for its use by a person.

Advantageously, but in a non-limiting way, the box is made of sheet metal.

Remarkably:

at least one slot 6 of the box 5 has a cross-section at least equal to the cross-section that the batch 3 intended to be placed inside the box 5 has in a predetermined transverse plane T of a group 1B of fingers 1A constituted by the stacking of the same fingers 1A of the gloves 1 in a batch 3, so that this group 1B of fingers can be inserted into the slot at least as far as the transverse plane T in question, the box 5 houses at least one so-called securing device 7 whose function is to hold the gloves 1 of the batch 3 in a stack from which each glove 1 can only be separated when it receives a force F of predetermined intensity in a direction substantially parallel to the longitudinal axis 1C of the one of its fingers 1A that is inserted into the slot 6, and this device 7 is positioned inside the box 5 in such a way that the predetermined group 1B of fingers 1A of the batch 3 projects through the slot 6 to the outside of the box 5 by a predetermined length L.

Preferably, the box 5 comprises only one slot 6 for the removal of the gloves.

The length L along which the group lB of glove fingers must project outside the box, is at least long enough to allow the grasping of a glove finger between the thumb and the index finger of a person's hand.

One skilled in the art will be able to determine this length L.

The precision with which the removal of gloves must be carried out makes it possible to considerably reduce the number of malicious acts involving the simultaneous removal of a plurality of gloves.

It will be noted that in order to achieve the object of the invention, the following are advantageously combined:

the fact that only a fraction of the batch 3 of gloves 1 is is accessible to the users (not shown) of the dispenser 4, which makes it possible to limit the extent of the area on which an action could be exerted in order to extract the entire batch 3, and the need to exert on each glove 1 an action of predetermined intensity in order to free it from the securing device 7, which also makes it possible to limit the number of gloves that can be extracted from the box 5 in a single operation.

Adherence to these primary technical principles makes it possible to construct a dispenser 4 of gloves 1 with which the number of gloves 1 that can be removed in a single operation is considerably reduced in relation to the dispensers of the prior art.

One skilled in the art will be able to determine the optimal value of the intensity of the action for extracting a glove 1.

Equally remarkably, the securing device 7 comprises at least one so-called interdigital stop 8, 9 at least indirectly integral with the box 5, which is:

disposed so as to rest in at least one interdigital space 1D, 1E common to the group 1B of fingers 1A inserted into the slot 6 and to a contiguous group 1F of fingers 1A, and oriented so as to assume the local support of each glove of the batch whose finger running through the slot is grasped for extraction, so that it acts in opposition to the displacement of each glove of the batch in the direction of its extraction through the slot.

When a pulling action is exerted on the finger of a glove projecting through the slot, the glove presses against each stop of the securing device, then a lateral folding of the glove occurs on either side of an axis that is substantially the same as the longitudinal axis of the grasped finger, making it possible for the glove to be released from the interdigital stops of the securing device and to be extracted through the slot 6.

This extraction operation works due to the flexibility of the sheet material constituting the gloves.

The extraction of the glove constituting each of the opposite sides of the batch is easy to obtain; the extraction of a glove located within the batch is slightly more difficult, though not impossible.

On the other hand, when a pulling action is exerted on a plurality of glove fingers projecting through the slot, the gloves press against each stop of the securing device, but the lateral folding of the gloves cannot be obtained due to the fact that the gloves are pressed against one another, thus preventing the gloves from being released by the securing device and extracted through the slot 6.

These technical characteristics make it possible for the extraction of a plurality of gloves in a single operation to be prevented, or at least largely impeded, due to the resistance to the extraction produced by the securing device 7 constituted in this way.

In a way that is equally remarkable, each slot 6, on the inside of the box 5, is bordered by walls 8A, 9A which determine a chute 10 having a width substantially equal to the width of the finger running through the slot and a length approximately equal to the fraction of the finger comprised inside the box.

The function of these walls 8A, 9A is to guide a group of fingers of the batch of gloves toward the slot 6 during the loading of a batch of gloves into the box.

Moreover, these walls make it possible to limit digital axis to the inside of the box.

In effect, when several gloves have been removed in succession, the thickness of the batch of gloves contained in the box thus being reduced, the group of fingers of the batch inserted into the slot no longer occupies its entire cross section, and digital access to the inside of the box is then possible.

These technical characteristics increase the difficulty of removing a plurality of gloves in a single operation.

Equally remarkably, at least one of the walls 8A, 9A which determine the chute 10 inside the box supports an interdigital stop 8, 9 of the securing device 7.

Remarkably, the internal volume of the box, at least locally, has a thickness E that is at least enough to allow the angling of the parts of the batch of gloves which adjoin the group of fingers intended to be inserted into the slot 6 but which do not project through this slot 6, in order to allow the positioning of the securing device 7 in the box 5 without allowing the wall of the box in which the slot 6 is disposed or the surrounding walls to press against the surfaces of the batch, thus preventing the desired insertion of the group of fingers into the slot.

Advantageously, when the glove has five fingers, including a middle finger that is longer than the other fingers (thumb, index finger, ring finger, little finger), it is the group of fingers corresponding to this middle finger that projects outside the box.

The length L of the projection formed by the group 1B of fingers outside the box need not in this case be limited to the difference in length between the middle finger and the other fingers of the gloves constituting the batch.

It suffices for the manufacturer of the dispenser to position the interdigital stops 8, 9 of the securing device 7 inside the box 5 in such a way that the predetermined group 1B of fingers 1A of the batch 3 projects through the slot 6 to the outside of the box 5 by the desired length L.

Remarkably, projecting from an external side 5B of the box which adjoins the slot 6, the box 5 supports at least one external portion having a disposition and a size such that, at least along the length L of the projection formed by the group 1B of fingers 1A outside this box 5, the movements of a person's hand for digitally grasping at least one finger 1A of a glove 1, are limited:

to those necessary for this digital grasping, and to those for pulling in a direction substantially parallel to the longitudinal axes of the fingers 1A of the group of fingers 1A which projects from the external surface 5B of the box 5.

In one embodiment, the external portion is constituted by a plate 11 which extends in a plane approximately perpendicular to the external surface 5B of the box 5 into which the slot 6 opens.

Advantageously, the plate 11 is comprised of an extension of one of the walls 5A of the box, and for example, when the box 5 comprises a front wall and a back wall, this plate 11 is an extension of the back wall.

Preferably, the front wall comprises a semi-circular slot 5C for the passage of the thumb of a person who grasps a glove finger between the thumb and the index finger.

Remarkably, in addition to at least one interdigital stop, the securing device 7 comprises:

at least one part 12 made of flat, rigid material, detachably connected at least to each of the gloves 1 of the batch 3 substantially at the level of a part of the glove 1 in which an opening for the insertion of a hand is provided, rods 14A, B supported at least indirectly by the box 5 and by each part 12 made of flat, rigid material, which are disposed on these elements 5, 12 so as to define the position of each glove 1 inside the box 5 in such a way as to obtain the alignment of a predetermined group 1B of fingers 1A along the center axis 6A of the slot 6 as well as the precise positioning of the batch 3 such that the predetermined group 1B of fingers 1A of this batch 3 projects through the slot 6 to the outside of the box 5 by the desired length L.

In the drawing, the thicknesses of the card and the gloves have been considerably enlarged for purposes of illustration.

The fact that the batch of gloves thus appears to be constituted by gloves joined with only one card must not be considered to be a limitation of the invention.

Advantageously, the stops at least indirectly supported by the box 5 are comprised of rods 14A which, being arranged according to a predetermined disposition, run substantially perpendicular to an internal surface 5C of the box, while at least some of the stops supported by each card 12 include apertures 13A, each of which is intended to receive one rod 14A, and which are disposed so as to allow the engagement of each card onto the rods in question.

Preferably, the card 12 made of flat, rigid material is comprised of a part made of cardboard on which a plurality of gloves is held.

For example, in order to be detachably connected to a card, each glove comprises a separable part which is itself anchored to the card 12, for example by means of clamps (not shown).

Remarkably, the rods 14B supported at least indirectly by the box 5, which are intended to cooperate with the shoulders 13B of each card 12 so as to determine the position of the gloves inside the box, are supported by a means 15 for adjusting their position in at least one direction in a plane substantially parallel to a center axis 6A of the slot 6. The presence of this means in the dispenser make it possible to eliminate errors in the positioning of the gloves on the cards that support them.

In a preferred embodiment:

the box 5 comprises two parts 51, 52, articulated on an axis 53 substantially parallel to one edge of the wall 5A in which the slot 6 is disposed, so as to define a loading opening 54 having an appropriate shape and size for the loading of a batch of gloves, the wall 5A in which the slot 6 is disposed supports, substantially within the plane of the loading opening 54, deflecting elements 55 which are limited in size so as not to impede the loading of a batch 3 of gloves 1, and at least large enough to impede the passage of the glove fingers 1A from the inside of the box to the plane of the loading opening.

Preferably, the box comprises a lock 56 and means for ensuring its impermeability to splashes of water.

One skilled in the art will be able to provide these dispositions without having to engage in any inventive activity.

We claim:

1. A dispenser (4) of gloves (1) made of sheet material, comprising a box (5) essentially constituted by at least one wall (5A), and having an internal volume capable of containing a batch (3) of a predetermined number of gloves (1) and a securing device (7) within the volume for holding the gloves (1) of the batch (3) in a stack from which each glove (1) is separated only when it receives a force (F) of predetermined intensity, and said wall (5A) having at least one slot (6) through which gloves (1) can be extracted, said dispenser being characterized in that:

said at least one slot (6) of the box (5) having a cross section at least equal to the cross section that the batch (3) intended to be placed inside the box (5) has in a predetermined transverse plane (T) of a group (1B) of fingers (1A) constituted by the stacking of the same fingers (1A) of the gloves (1) of a batch (3) so that said group (1B) of fingers can be inserted into the slot (6) at least as far as the transverse plane (T) in question, the securing device (7) being positioned inside the box (5) in such a way that the predetermined group (1B) of fingers (1A) of the batch (2) projects through the slot (6) to the outside of the box (5) by a predetermined length (L) so that each glove can only be separated from the batch when the one of its fingers (1A) that is inserted into the slot (6) receives the force (F) in a direction substantially parallel to its longitudinal axis.

2. The glove dispenser according to claim 1, characterized in that the securing device (7) comprises at least one interdigital stop (8, 9) at least indirectly integral with the box (5) and disposed so as to rest in at least one interdigital space (1D, 1E) common to the group (1B) of fingers (1A) inserted into the slot (6) and to a contiguous group (1F) of fingers (1A), and oriented so as to assume the local support of each glove of the batch whose finger running through the slot is grasped for extraction, so that it acts in opposition to the displacement of each glove of the batch in the direction of its extraction through the slot.

3. The glove dispenser according to claim 2 characterized in that in addition to at least one interdigital stop, the securing device (7) comprises:

at least one flat, rigid part (12) detachably connected at least to each of the gloves (1) of the batch (3) substantially at the level of a part of the glove (1) having an opening for the insertion of a hand, and stops (13, 14) supported at least indirectly by the box (5) and by each part (12) of flat, rigid material, which are disposed on these elements (5, 12) so as to define the position of each glove (1) inside the box (5) in such a way as to obtain the alignment of a predetermined group (1B) of fingers (1A) along the center axis (6A) of the slot (6), and the precise positioning of the batch (3), such that the predetermined group (1B) of fingers (1A) of this batch (3) project through the slot (6) to the outside of the box (5) by the desired length (L).

4. The glove dispenser according to claim 3, characterized in that the stops (14) supported at least indirectly by the box (5), and intended to cooperate with the stops (13) of each card (12) so as to determine the position of the gloves inside the box, means (15) for adjusting the position of the gloves in at least one direction in a plane substantially parallel to a center axis (6A) of the slot (6).

5. The glove dispenser according to claim 1, in that each slot (6) is bordered on the inside of the box (5) by walls (8A, 9A) which determine a chute (10) having a width substantially equal to the width of the finger running through the slot and a length approximately equal to the fraction of the finger comprised inside the box.

6. The glove dispenser according to claim 5, characterized in that at least one of the walls (8A, 9A) determines a chute (10) on the inside of the box and supports an interdigital stop (8, 9) of the securing device (7).

7. The glove dispenser according to claim 6, characterized in that the internal volume of the box, at least locally, has a thickness (E) that allows the angling of parts of the batch of gloves which adjoin the group of fingers intended to be inserted into the slot (6) but which do not project through said slot (6), and that in order to allow the positioning of the securing device (7) in the box (5) without allowing the wall of the box in which the slot (6) is disposed or the surrounding walls to press against the surfaces of the batch, thus preventing the desired insertion of the group of fingers into the slot.

8. The glove dispenser according to claim 1, characterized in that, at least one external stop (11) projecting from an external surface (5B) adjoining the slot (6), said stop having a disposition and a size such that, at least along the length (L) of the projection formed by the group (1B) of fingers (1A) outside said box (5), the movements of a person's hand for digitally grasping at least one finger (1A) of a glove (1) are limited:

to those necessary for said digital grasping, and to those for pulling in a direction substantially parallel to the longitudinal axes of the fingers (1A) of the group of fingers (1A) which projects from the external surface (5B) of the box (5).

9. The glove dispenser according to claim 1, characterized in that:

the box (5) comprises two parts (51, 52) articulated on an axis (53) substantially parallel to one edge of the wall (5A) in which the slot (6) is disposed, so as to define a loading opening (54) having an appropriate shape and size for the loading of a batch of gloves, and a wall (5A) disposal in the slot (6) is disposed, said wall supporting substantially within the plane of the loading opening (54), deflecting elements (55), said deflecting elements being limited in size so as not to impede the loading of a batch (3) of gloves (1), and large enough to impede the passage of the glove fingers (1A) from the inside of the box to the plane of the loading opening.

* * * * *